US008670004B2

(12) United States Patent
Vieri et al.

(10) Patent No.: US 8,670,004 B2
(45) Date of Patent: Mar. 11, 2014

(54) DRIVING LIQUID CRYSTAL DISPLAYS

(75) Inventors: Carlin J. Vieri, Menlo Park, CA (US); Michael Bolotski, Seattle, WA (US)

(73) Assignee: Pixel Qi Corporation, San Bruno, CA (US)

( * ) Notice: Subject to any disclaimer, the term of this patent is extended or adjusted under 35 U.S.C. 154(b) by 325 days.

(21) Appl. No.: 12/630,800

(22) Filed: Dec. 3, 2009

(65) Prior Publication Data

US 2010/0231614 A1 Sep. 16, 2010

Related U.S. Application Data

(60) Provisional application No. 61/160,705, filed on Mar. 16, 2009, provisional application No. 61/160,697, filed on Mar. 16, 2009, provisional application No. 61/160,692, filed on Mar. 16, 2009.

(51) Int. Cl.
*G09G 5/10* (2006.01)

(52) U.S. Cl.
USPC ..... 345/690; 345/694; 345/696; 345/698; 345/614; 345/613; 345/612; 345/214; 345/212; 345/90; 345/89; 345/87

(58) Field of Classification Search
None
See application file for complete search history.

(56) References Cited

U.S. PATENT DOCUMENTS

| | | | |
|---|---|---|---|
| 4,672,457 | A | 6/1987 | Hyatt |
| 5,398,041 | A | 3/1995 | Hyatt |
| 5,432,526 | A | 7/1995 | Hyatt |
| 5,748,828 | A | 5/1998 | Steiner et al. |
| 5,870,164 | A | 2/1999 | Lu et al. |
| 5,952,680 | A | 9/1999 | Strite |
| 6,341,002 | B1 | 1/2002 | Shimizu et al. |
| 6,674,420 | B2 | 1/2004 | Matsueda et al. |
| 6,831,662 | B1 | 12/2004 | Lum et al. |
| 6,920,359 | B2 | 7/2005 | Meadows et al. |
| 6,930,664 | B2 | 8/2005 | Kim et al. |
| 7,008,409 | B2 | 3/2006 | Spiezio et al. |
| 7,196,766 | B2 | 3/2007 | Yang et al. |
| 7,248,315 | B2 | 7/2007 | Arai et al. |
| 7,358,943 | B2 | 4/2008 | Asao |

(Continued)

FOREIGN PATENT DOCUMENTS

| | | | |
|---|---|---|---|
| CN | 1599879 | A | 3/2005 |
| CN | 2852196 | Y | 12/2006 |

(Continued)

OTHER PUBLICATIONS

International Searching Authority, "International Search Report and Written Opinion", application No. PCT/US2009/066838, dated Jul. 2, 2010, 13 pages.

(Continued)

*Primary Examiner* — Joseph Haley
*Assistant Examiner* — Ifedayo Iluyomade
(74) *Attorney, Agent, or Firm* — Hickman Palermo Truong Becker Bingham Wong LLP

(57) ABSTRACT

In an embodiment, a pixel driving circuit comprises: one or more source drivers for enabling a first subpixel of a subpixel pair to receive first data and a second subpixel of the subpixel pair to receive second data; one or more source drivers for driving the first data to the first subpixel and the second data to the second subpixel, wherein the first data is different than the second data.

30 Claims, 15 Drawing Sheets

(56) References Cited

U.S. PATENT DOCUMENTS

| | | | | |
|---|---|---|---|---|
| 7,388,635 | B2 | 6/2008 | Aoki | |
| 7,463,327 | B2 | 12/2008 | Tasaka et al. | |
| 7,692,672 | B2 | 4/2010 | Jones et al. | |
| 7,876,406 | B2 | 1/2011 | Nagai et al. | |
| 8,111,360 | B2 | 2/2012 | Nagai et al. | |
| 2002/0003521 | A1 | 1/2002 | Matsueda et al. | |
| 2002/0060657 | A1 | 5/2002 | Matsueda et al. | |
| 2002/0145688 | A1 | 10/2002 | Sekiguchi | |
| 2004/0201560 | A1 | 10/2004 | Shen et al. | |
| 2004/0201814 | A1 | 10/2004 | Yamamoto | |
| 2004/0252092 | A1 | 12/2004 | Roosendaal | |
| 2006/0007194 | A1 | 1/2006 | Verschueren et al. | |
| 2006/0044240 | A1 | 3/2006 | Takizawa et al. | |
| 2007/0046606 | A1 | 3/2007 | Kim et al. | |
| 2007/0085804 | A1 | 4/2007 | Tajiri | |
| 2007/0164953 | A1 | 7/2007 | Huang et al. | |
| 2007/0242014 | A1 | 10/2007 | Lee et al. | |
| 2007/0242197 | A1 | 10/2007 | Watson et al. | |
| 2007/0268418 | A1 | 11/2007 | Lin et al. | |
| 2008/0030656 | A1 | 2/2008 | Watson et al. | |
| 2008/0055519 | A1* | 3/2008 | Battersby et al. | 349/68 |
| 2008/0074592 | A1 | 3/2008 | Araki et al. | |
| 2008/0100601 | A1 | 5/2008 | Moon et al. | |
| 2008/0117346 | A1 | 5/2008 | Jepsen | |
| 2008/0170018 | A1 | 7/2008 | Jones et al. | |
| 2008/0225189 | A1* | 9/2008 | Yang et al. | 349/37 |
| 2008/0239178 | A1* | 10/2008 | Nagai et al. | 349/33 |
| 2008/0284719 | A1 | 11/2008 | Yoshida et al. | |
| 2009/0009447 | A1 | 1/2009 | Naka et al. | |
| 2009/0059107 | A1 | 3/2009 | Nagai et al. | |
| 2009/0090604 | A1 | 4/2009 | Srinivasan et al. | |
| 2010/0020054 | A1 | 1/2010 | Jepsen | |

FOREIGN PATENT DOCUMENTS

| | | | |
|---|---|---|---|
| CN | 101153999 | A | 4/2008 |
| CN | 201069506 | Y | 6/2008 |
| JP | 2003-248221 | A | 9/2003 |
| JP | 2004031005 | A | 1/2004 |
| JP | 2004-045757 | A | 2/2004 |
| JP | 2004-163893 | A | 6/2004 |
| JP | 2004-279765 | A | 10/2004 |
| JP | 2004-310005 | A | 11/2004 |
| JP | 2007041572 | A | 2/2007 |
| JP | 2007-223991 | | 9/2007 |
| JP | 2008046329 | A | 2/2008 |
| JP | 2008-52259 | A | 3/2008 |
| JP | 2008052259 | A | 3/2008 |
| JP | 2008/516280 | A | 5/2008 |
| JP | 2008-225472 | A | 9/2008 |
| TW | 2004212434 | A | 10/2004 |

OTHER PUBLICATIONS

Current Claims, application No. PCT/US2009/066838, 6 pages.
International Searching Authority, "International Search Report and Written Opinion", application No. PCT/US2009/050787, dated Feb. 17, 2010, 10 pages.
Current Claims, application No. PCT/US2009/050787, 4 pages.
International Searching Authority, "International Search Report and Written Opinion", application No. PCT/US2009/051946, dated Mar. 3, 2010, 15 pages.
Current Claims, application No. PCT/US2009/051946, 11 pages.
International Searching Authority, "International Search Report and Written Opinion", application No. PCT/US2009/051950, dated Mar. 15, 2010, 10 pages.
Current Claims, application No. PCT/US2009/051950, 6 pages.
Wu, S.T., et al., "Mixed-Mode Twisted Nematic Liquid Crystal Cells for Reflective Displays", Applied Physics Letters, vol. 68, published Jan. 1996, 3.
Wright, et al., "Resolution and Legibility: A comparison of TFTLCDs and CRTs", SID Digest, 1999, 4 pages.
Yoshitake, et al., "The Relationship between Pixel Density and Readability on Computer Displays-Effectiveness of an Anti-Aliased Front on a High Density LCD", SID Digest, 2003, 4 pages.
Japan Patent Office, "Notice of Grounds for Rejection", in application No. 2011-521241, dated Jan. 17, 2013, 5 pages.
Current Claims in application No. 2011-521241, dated Jan. 2013, 4 pages.
Office Action in application No. 10-2011-7024412, dated Oct. 22, 2012, 10 pages.
Current Claims in application No. 10-2011-7024412, dated Oct. 2012, 8 pages.
The State Intellectual Property Office of the People's Reublic of China, "First Office Action", in application No. 200980129831.6, dated Dec. 28, 2012, 12 pages.
Current Claims in China application No. 200980129831.6, dated Dec. 2012, 9 pages.
Noticeof Grounds for Rejection in application No. 2012-500777, dated Feb. 19, 2013, 5 pages.
Current Claims in application No. 2012-500777, dated Feb. 2013, 5 pages.
Korean Patent, Notice to file a response in application No. 10-2011-7024412, dated Apr. 26, 2013. 2 pages.
Current Claims in Korean application No. 10-2011-7024412, dated Apr. 2013, 9 pages.
The State Intellectual Property Office of the People's Republic of China, "Second Office Action" in application No. 20090129831.6, dated Jun. 8, 2013, 16 pages.
Current Claims in application No. 20090129831.6, dated Jun. 2013, 9 pages.
The State Intellectual Property Office of the People's Republic of China, "First Office Action" in application No. 200980158129.2, dated Mar. 28, 2013, 15 pages.
Current Claims in application No. 200980158129.2, dated Mar. 2013, 5 pages.
Japan Office Action in application No. 2012-50077, Sep. 3, 2013, 3 pages.
Current Claims in application No. 2012-50077, dated Sep. 2013, 5 pages.

* cited by examiner

3 Source (column), 2 Gate (row)
"3S-2G-RGBstripe"

3 Source, 2 Gate, typed
"3S-2G-T"

3 Source (column), 2 Gate (row), Untyped row
"3S-2G-U"

6 Source (column), 1 Gate (row)
"6S-1G"

6 Source, 2 Gate, typed row
"6S-2G-T"

1 Source (column), 6 Gate (row)
"1S-6G"

2 Source, 3 Gate, untyped row
"2S-3G-U"

DRIVING LIQUID CRYSTAL DISPLAYS

CROSS-REFERENCE TO RELATED APPLICATIONS; BENEFIT CLAIM

This application claims benefit of U.S. Provisional Applications 61/160,705 (filed Mar. 16, 2009), 61/160,697 (filed Mar. 16, 2009), and 61/160,692 (filed Mar. 16, 2009), the entire contents of which are hereby incorporated by reference as if fully set forth herein, under 35 U.S.C. §119(e).

FIELD OF THE INVENTION

The disclosure generally relates to liquid crystal displays and to circuits for separately or jointly addressing transmissive and reflective portions of pixels in liquid crystal displays.

BACKGROUND

The liquid crystal display (LCD) is widely used in computing devices and electronic devices such as laptop computers, notebook computers, cell phones, handheld computers, and various kinds of terminals and display units. Typically an LCD operates and is structured as a backlit transmissive display, reflective display, or transflective display.

LCD panels generally include an array of pixels for displaying images. The pixels often each include three or more subpixels, with each subpixel displaying a color (e.g., red, blue, green, and in some instances, white light). To display an image, the appropriate subpixels on the display are rendered transmissive or reflective to light, allowing color-filtered or unfiltered light to pass through each of the transmissive or reflective subpixels and form the image. The subpixels are often arranged in a grid and can be addressed and individually adjusted according to their row and column in the grid. Generally, each subpixel includes a transistor that is controlled according to a row signal and a column signal. For instance, the gate of a transistor in a subpixel may connect to a gate line generally extending in the row direction, and a source of the transistor in the subpixel may connect to a source line generally extending in the column direction. Often, a plurality of the transistors in the same row has gates connected to the same gate line, and a plurality of the transistors in the same column has sources connected to the same source line.

An individual subpixel is typically addressed by turning on that subpixel's transistor through the gate line and transmitting image data relevant to the individual sub-pixel through that subpixel's source line. By repeating this addressing process for each of the pixels in the display, an image may be formed, and by sequentially displaying changing images, video may be displayed.

Some LCDs use transflective pixels, in which a single pixel has both transmissive and reflective portions, but they are typically addressed in a way that stores the same image data on both the transmissive and reflective portions.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY OF THE DISCLOSURE

In an embodiment, a method comprises sending, from a first source driver, a first value to a first subpixel of a subpixel pair; and, sending, from a second source driver, a second value to a second subpixel of the subpixel pair, wherein the first value is different than the second value. In an embodiment, the first subpixel of the subpixel pair is a transmissive subpixel, and the second subpixel of the subpixel pair is a reflective subpixel. In an embodiment, the first source driver is the same as the second source driver. In an embodiment, the second value is a black voltage value.

In an embodiment, a display panel comprises: a pixel array with a plurality of pixels arranged in rows and columns, wherein one or more pixels of the plurality of pixels comprise one or more subpixel pairs; first logic configured to drive a first value to a first subpixel of the subpixel pair; second logic configured to drive a different value to a second subpixel of the subpixel pair. In an embodiment, the display panel comprises mode selection logic configured to cause the display panel to operate in a plurality of modes comprising a first mode wherein the different value is a black voltage value and a second mode wherein the different value is the same as the first value. In an embodiment, the first logic comprises two gate row drivers for each row in the pixel array and three source drivers for each row in the pixel array.

In an embodiment, a pixel driving circuit comprises one or more gate row drivers for enabling a first subpixel of a subpixel pair to receive pixel data independently of a second subpixel of the subpixel pair receiving a different value; a source driver for driving the pixel data to the first subpixel via a source line; logic configured to disconnect the source driver from the source line; value generation logic configured to drive the different value to the second subpixel of the subpixel pair. In an embodiment, the value generation logic is configured to drive the different value to the second subpixel via the source line. In an embodiment, the different value is a black voltage value.

In an embodiment, a pixel driving circuit comprises: one or more gate row drivers for enabling a first subpixel of a subpixel pair to receive data and enabling a second subpixel of the subpixel pair to receive data; one or more source drivers configured to drive pixel data to the first subpixel and drive a preprogrammed value to the second subpixel. In an embodiment, the circuit further comprises logic for controlling the timing of driving the pixel data and the preprogrammed value. In an embodiment, the circuit further comprises logic for delivering the pixel data to the one or more source drivers. In an embodiment, the circuit further comprises mode selection logic configured to cause the display panel to operate in a plurality of modes comprising a first mode wherein the preprogrammed value is a black voltage value and a second mode wherein the one or more source drivers drives pixel data to the second subpixel.

In an embodiment, a pixel driving circuit comprises first circuitry configured to store, on a first subpixel of a first subpixel pair, a first voltage value and second circuitry configured to store, on a second subpixel of the first subpixel pair, a second voltage value. In an embodiment, the first subpixel is a transmissive subpixel, and the second subpixel is a reflective subpixel. In an embodiment, the first voltage value represents pixel data, and wherein the second voltage value is a black voltage value.

In an embodiment, a pixel driving circuit comprises one or more gate row drivers for enabling a first subpixel of a subpixel pair to receive pixel data independently of a second subpixel of the subpixel pair receiving a different value; one or more source drivers for driving the pixel data and the different value via one or more source lines; and logic configured to deliver the pixel data and the different value to the one or more source drivers. In an embodiment, the first subpixel is a transmissive subpixel and the second subpixel is a reflective subpixel. In an embodiment, the different value is a black voltage value.

In an embodiment, a pixel driving circuit comprises one or more gate row drivers for enabling a first subpixel of a subpixel pair to receive first data from a source line and further enabling a second subpixel of the subpixel pair to receive second data from the source line; a source driver for driving first data to the first subpixel via the source line; switching logic for enabling the pixel driving circuit to operate in a plurality of modes comprising a first mode, wherein the second subpixel receives the first data from the source line and the second data is the same as the first data, or a second mode, wherein the second subpixel receives second data that is different than the first data.

In an embodiment, a pixel driving circuit comprises a gate row driver for enabling one or more subpixels of one or more subpixel pairs to receive data; a source driver for driving the data to the one or more subpixels; switching logic configured to cause the pixel driving circuit to operate in a plurality of configurations comprising a first configuration wherein the gate row driver enables a first subpixel of a subpixel pair to receive first data from the source driver, a second configuration wherein the gate row driver enables a second subpixel of the subpixel pair to receive second data from the source driver, the second data being different than the first data. In an embodiment, the switching logic is further configured to cause the pixel driving circuit to operate in a third configuration wherein the gate row driver enables the first subpixel to receive third data from the source driver and the second subpixel to receive the third data from the source driver.

In an embodiment, a pixel driving circuit comprises one or more source drivers; a first gate row driver configured to enable first subpixels of subpixel pairs to receive first data from the one or more source drivers; a second gate row driver configured to enable second subpixels of the subpixel pairs to receive second data from the source driver, the second data being different than the first data. In an embodiment, the first subpixel pairs comprise both transmissive and reflective subpixels, and the second subpixel pairs comprise both transmissive and reflective subpixels.

In an embodiment, a pixel driving circuit comprises a gate row driver configured to enable a first subpixel of a subpixel pair to receive first data and to enable a second subpixel of a the subpixel pair to receive second data; a first source driver configured to drive the first data to the first subpixel; a second source driver configured to drive the second data to the second subpixel, wherein the second data is different than the first data. In an embodiment, the gate row driver is further configured to enable a third subpixel of a second subpixel pair to receive third data, the pixel driving circuit further comprises a third source driver configured to drive the third data to the third subpixel.

In an embodiment, a pixel driving circuit comprises a first source driver; a first gate row driver, the first gate row driver configured to enable a first subpixel of a subpixel pair to receive first data from the first source driver; a second source driver; a second gate row driver, the second gate row driver configured to enable a second subpixel of the subpixel pair to receive second data, wherein the second data is different than the first data.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Pixel Layout and Modes of Operation

Figure 1:
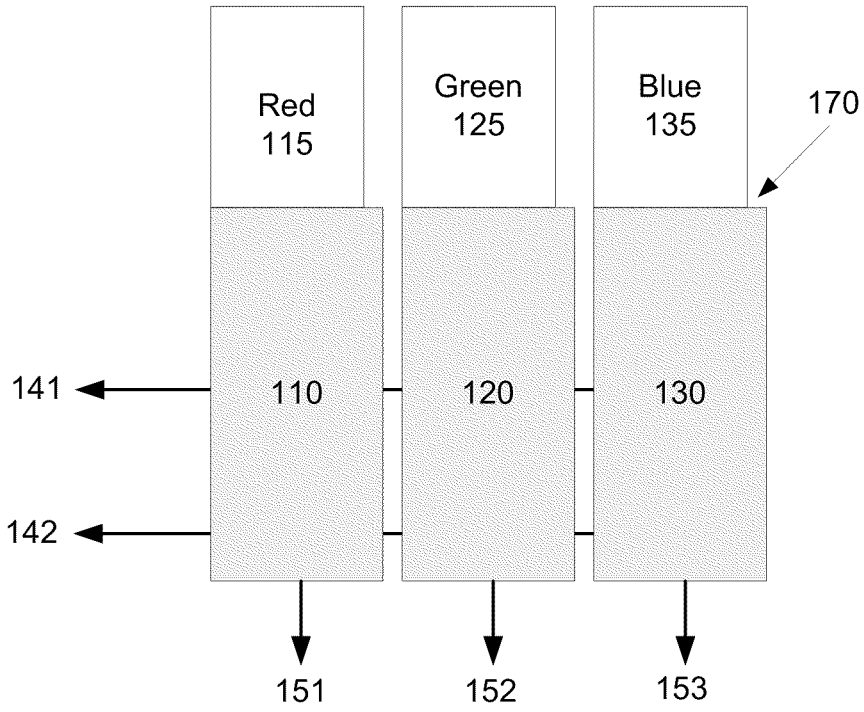
FIG. 1 shows an example pixel layout for a pixel comprising three subpixel pairs for a total of six subpixels.

FIG. 1 shows an example pixel layout for a pixel comprising three subpixel pairs for a total of six subpixels. The pixel comprises three reflective subpixels 110, 120, 130 and three transmissive subpixels 115, 125, 135. Six transistors (not shown), one for each subpixel, can be placed under the reflective portions 110, 120, 130 of the pixel. Two gate lines 141, 142 can run horizontally under the reflective portions 110, 120, 130. One of the gate lines, for example, gate line 141, is coupled to the transmissive subpixels 115, 125, 135 and is referred throughout this disclosure as a transmissive gate line. One of the gate lines, for example gate line 142, is coupled to the reflective portions of the subpixels and is referred to throughout this disclosure as a reflective gate line. Source lines 151, 152, 153 can run vertically and be partly or completely hidden in the interpixel spaces between the optically active portions of the subpixels. The "notches" 170 in the transmissive 115, 125, 135, part of the pixel indicate the vertical routing of the source lines. These wires may block a portion of the transmissive area 115, 125, 135.

Techniques described herein are provided for storing distinct image values on the transmissive 115, 125, 135 and reflective portions 110, 120, 130 of a single pixel, which conveys several advantages. For example, in a pixel design as shown in FIG. 1, if all the reflective subpixels 110, 120, 130 are driven with black image data, and the transmissive subpixels 115, 125, 135 are driven with arbitrary image data, the panel is effectively operating in a purely transmissive mode and mimics a transmissive LCD. The reflective subpixels 115, 125, 135, when driven to black, contribute little or nothing to the image seen by the viewer. Black image data, also referred to as a black voltage value, is a voltage or series of voltages that, for a particular liquid crystal material and mode of operation, will modulate the liquid crystal material so as to make a particular subpixel appear dark or black. A "black voltage" may not be a single DC value, but may need to be time varying to maintain the dark state of a subpixel.

If the transmissive portions 115, 125, 135 and reflective portions 110, 120, 130 are driven with the same image data, the panel can mimic a transflective panel if the panel's backlight is turned on. If the backlight is turned off, the transmissive portions of the display are black because there is no backlight illumination to transmit, causing the display to behave as a purely reflective panel.

When the display is operating in a purely transmissive mode, the different image data stored on the red, green, and blue subpixels 115, 125, 135 allows for the creation of a variety of colors beyond purely red, green, and blue. Similarly, the reflective subpixel portions 110, 120, 130 may be driven with image data that is some function of the red, green, and blue image data when operating in a transflective or reflective mode. For example, as mentioned above, in a pixel with six subpixels, each reflective subpixel 110, 120, 130 may be paired with a transmissive subpixel 115, 125, 135, and both subpixels in a pair may be driven with the same image data. In this embodiment, the reflective portion of the viewed image will be similar or identical in relative intensity to the transmissive portion of the viewed image.

An alternate embodiment is to drive all the reflective subpixels 110, 120, 130 in a single pixel to the same value. For example, it is possible to compute a combined single "luminance" value for a pixel from the incoming red, green, and blue image values. All reflective subpixels 110, 120, 130 in a single pixel could be driven to this computed luminance value. In this embodiment, the reflective portion 110, 120, 130 of the viewed image will be similar to the luminance of the original full color image. This may be particularly useful if the reflective subpixels 110, 120, 130 are not covered, fully or partially, by color filters, and therefore produce grayscale images.

In a pixel design with three reflective subpixels per pixel and if the reflective subpixels are not covered by color filters or are only partially covered by color filters, enhanced resolution images can be produced in the reflective and transflective modes. For example, in the purely reflective mode, the reflective subpixels 110, 120, 130 may be driven to different values. As there are three reflective subpixels 110, 120, 130 per pixel, the LCD may display images with three times the pixel resolution compared to the resolution using just the transmissive subpixels 115, 125, 135.

A computer or display driver can support driving pixel data to the reflective subpixels 110, 120, 130 independently of the transmissive subpixels 115, 125, 135. The ability for a single panel to operate as a purely transmissive, purely reflective, or transflective panel can be useful for viewing different types of image content or in different viewing environments.

The six subpixel design of FIG. 1 is an example embodiment. For example, a pixel with three transmissive subpixels and one reflective subpixel could also be used.

Circuits for Transmissive, Reflective, and Transflective LCD Pixels

In an embodiment, an LCD comprises transflective pixels driven by circuits that provide for independently addressing the transmissive and reflective parts of an LCD pixel. To separate a single subpixel into transmissive and reflective parts, in one embodiment red, green, and blue subpixels and their associated reflective portions may be formed using "subpixel pairs."

Figure 7:
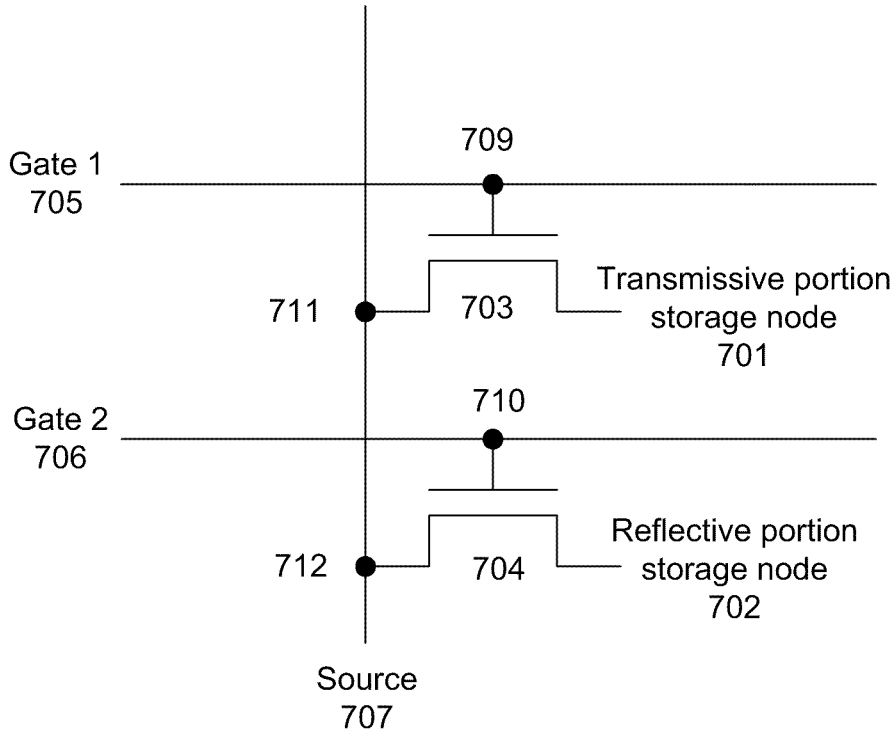
FIG. 7 shows a subpixel pair comprising a transmissive subpixel and a reflective subpixel.

FIG. 7 shows an example of a subpixel pair comprising a transmissive subpixel and a reflective subpixel. In an embodiment, a pixel comprises three subpixel pairs like the one shown in FIG. 7. Each subpixel may be colored (with a color filter over all or a portion of the subpixel) or grayscale (with no or almost no color filter over the subpixel). In this embodiment, a pixel has six electrically separate storage nodes (one each for red, green, and blue transmissive portions and three for the reflective portions).

The six storage nodes may be electrically separated using one or more transistors 703, 704 to control access to each storage node. A variety of electrical connection topologies are possible to control the separate transistors 703, 704. Generally, each transistor 703, 704 will be connected to a gate wire 705, 706, a source wire 707, and a storage node 701, 702. FIG. 7 shows an embodiment that uses one transistor 709 for access to the transmissive storage node and one transistor 710 for access to the reflective storage node. The gate wires 705, 706 are electrically separated, but the source connections 711, 712 are connected together. Other embodiments are possible, and discussed below.

Pixel Driving Circuitry Considerations

A variety of pixel circuit designs and configurations are possible, and these different pixel designs influence the pixel driving circuitry design. Additionally, in an embodiment in which the transmissive and reflective subpixels may be driven to different values, it may be desirable to drive all the reflective subpixels to a black voltage value to allow the display to operate in a purely transmissive mode.

In one embodiment, circuit logic may implement a pixel driving method comprising sending, from a first source driver, a first value to a first subpixel of a subpixel pair; sending, from a second source driver, a second value to a second subpixel of the subpixel pair, wherein the first value is different than the second value. In one aspect, the first subpixel of the subpixel pair is a transmissive subpixel and the second subpixel of the subpixel pair is a reflective subpixel. In another aspect, the first source driver is the same as the second source driver. In a further aspect, the second value is a black voltage value. Particular examples for implementing such driving methods are further described herein with respect to FIG. 2, FIG. 3.

Multiple pixel driving circuitry embodiments are discussed below, followed by details of example pixel designs that may apply to these or other pixel driving circuits. A variety of pixel embodiments may be applicable to each of the pixel driving circuit and system embodiments.

Pixel Driving Circuitry with Black Voltage Generator

Figure 2:
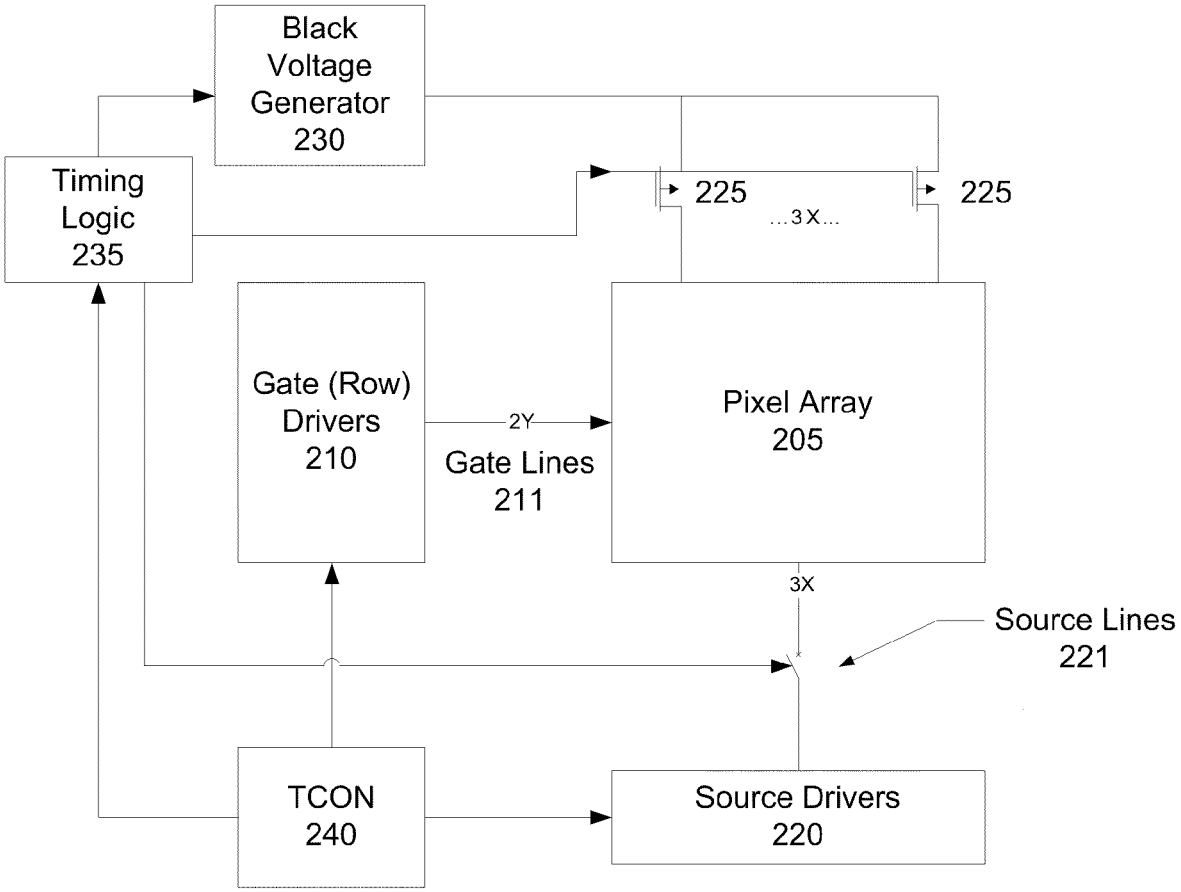
FIG. 2 shows a circuit or system for driving pixel data to the pixels of an LCD panel.

FIG. 2 shows a block diagram of a circuit or system for driving pixel data to the pixels of an LCD panel. The circuit utilizes gate line pairs 211 comprising one gate line for reflective subpixels on a particular row and one gate line for the transmissive subpixels on that same row. The diagram illustrates a circuit for an X column by Y row pixel array 205. Each pixel in this example can be configured as described in relation to FIG. 1 and made up of six subpixels comprising three transmissive subpixels (red, green, and blue) and three reflective subpixels. It should be apparent, however, that the techniques described herein are not limited to such a configuration. For example, a pixel layout comprising three transmissive subpixels and one reflective subpixel might also be used.

The embodiment of FIG. 2 comprises a plurality of gate row drivers 210. In one configuration, the system will have one gate row driver 210 for each row of transmissive subpixels and one gate row driver 210 for each row of reflective subpixels. Thus, if the pixel array 205 has a total of Y rows, then the circuit will implement 2Y gate row drivers 210. Each of the gate row drivers 210 is coupled to the pixel array 205 by a gate line 211. Each row will have both a reflective gate line and a transmissive gate line. A first gate row driver 210 for the row enables the transmissive subpixels via the transmissive gate line, and a second gate row driver 210 enables the reflective subpixels via the reflective gate line.

The embodiment of FIG. 2 further comprises a plurality of source drivers 220. In one configuration, the system will have one source driver 220 for each column of subpixel pairs in a column of pixels. Thus, if the pixel array 205 has X columns, then the circuit will implement 3X source drivers. Each of the three source drivers 220 is coupled to the pixel array by a source line 221.

The embodiment of FIG. 2 further comprises "flash clear" transistors 225 connected to each source line 221 at the opposite end of the source drivers 220; a black voltage generator circuit 230 connected to the source lines 221 through the flash clear transistors 225; a timing logic circuit 235; and a timing controller 240 (also referred to as a "TCON" throughout this disclosure). In some embodiments the timing logic 235 and TCON 240 are integrated into a common circuit.

To operate the panel in a transmissive mode, the transmissive gate driver of a first row enables the transmissive gates of the first row, and the source drivers 220 drive the transmissive subpixels of the first row to a set of desired voltages to generate desired colors. The timing logic 235 disconnects the source drivers 220 from the source lines 221; clocks the gate drivers 210 once to enable the reflective gates of the first row; and connects the black voltage generator 230 to the source lines 221 via the "flash clear" transistors 225. The black voltage generator 230 then sets the reflective subpixels to a black voltage value. The timing logic 235 then clocks the gate drivers 210 once to enable the transmissive gates of the next row. This process is repeated for each row in the pixel array 205.

To operate the panel in a transflective mode, the reflective subpixel of each subpixel pair receives the same value as the transmissive subpixel. In this mode, the black voltage generator 230 and the "flash clear" transistors 225 do not need to be used. For a first row, the gate drivers 210 enable the transmissive gates of the first row, and the source drivers 220 drive the transmissive subpixels of the first row to a set of desired voltages to generate desired colors. The TCON 240 clocks the gate drivers 210 to enable the reflective gates of the first row, and the source drivers 220 drive the reflective subpixels to the same voltage as the transmissive subpixels. This process is repeated for each row in the pixel array 205. To reduce power consumption in the transflective mode, techniques of the present disclosure include placing the black voltage generator 230 into a standby mode.

When operating the panel in a reflective mode, the voltages on the transmissive subpixels do not matter, as the backlight is off. The display will be operated as a 3X by Y reflective device. The display can be driven in the same manner as for the transflective mode.

Driving Pixels with Multi-Mode Source Drivers

Figure 3:
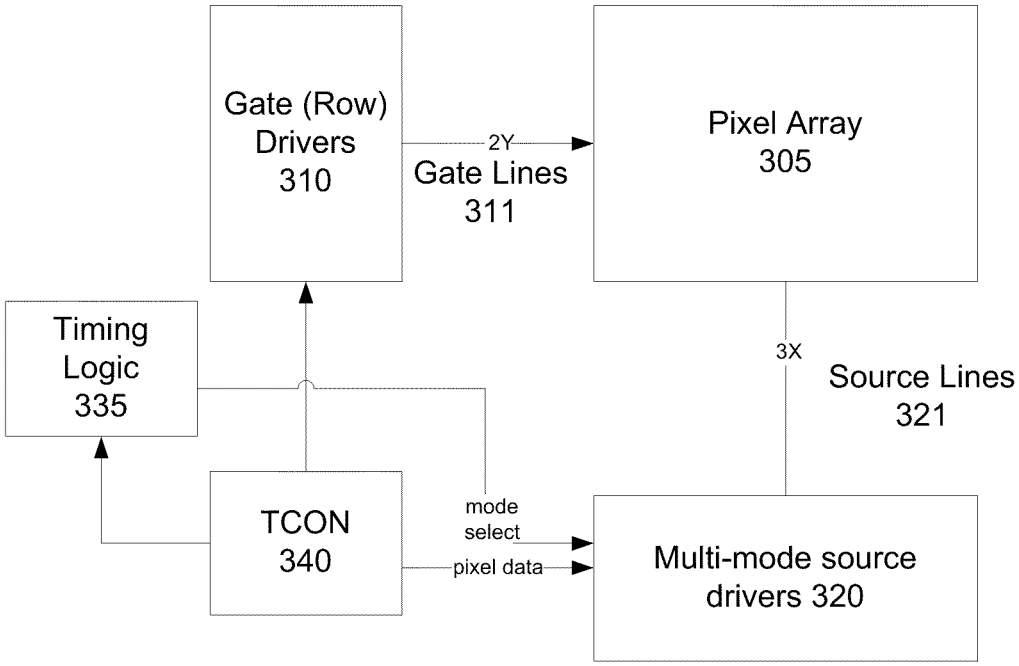
FIG. 3 shows a circuit or system for driving pixel data to the pixels of an LCD panel.

FIG. 3 shows a block diagram of a circuit or system for driving pixel data to the pixels of an LCD panel. The circuit utilizes gate line pairs comprising one gate line for reflective subpixels and one gate line for transmissive subpixels. The diagram describes a circuit for an X column by Y row pixel array 305. Each pixel in this example is configured as described in relation to FIG. 1 and made up of six subpixels comprising three transmissive subpixels (red, green, and blue) and three reflective subpixels. It should be apparent, however, that the techniques described herein are not limited to such a configuration. For example, a pixel layout comprising three transmissive subpixels and one reflective subpixel might also be used.

The embodiment of FIG. 3 comprises two gate row drivers 310 for each row of pixels so that if the pixel array 305 has a total of Y rows, then the circuit will implement 2Y gate row drivers 310. Each of the two gate row drivers 310 is coupled to the pixel array 305 by a gate line 311. Each row will have both a reflective gate line and a transmissive gate line. A first gate row driver for the row enables the transmissive subpixels via the transmissive gate line, and a second gate row driver enables the reflective subpixels via the reflective gate line. The embodiment of FIG. 3 further comprise multi-mode source drivers 320, with one source driver for each of the three transmissive/reflective subpixel pairs in a pixel. If the pixel array 205 has X columns, then the circuit will implement 3X source drivers 320. Each of the 3X source drivers 320 is coupled to the pixel array 305 by a source line 321.

In this embodiment, the source drivers 320 have the capability of storing one or more preprogrammed pixel values in addition to regular pixel data. The source drivers 320 can be switched between the incoming pixel data from the TCON 340 and the pre-programmed values. The timing logic 335 is triggered at the end of every data line by the TCON 340. The timing logic 335 switches the multi-mode source drivers 320 to use one of the pre-programmed values. For example, the pre-programmed values might be a black pixel value that can be used to drive reflective subpixels to a black voltage value.

To operate the panel in a transmissive mode, the transmissive gate driver 310 of a first row enables the transmissive gates of the first row, and the source drivers 320 drive the transmissive subpixels of the first row to a set of desired voltages to generate desired colors. The TCON 340 clocks the gate drivers 310 to enable the reflective gate drivers. At the end of every data line, the TCON 340 triggers the timing logic 335, and the timing logic 335 can signal to the multi-mode source drivers 320 to drive the reflective subpixels to a pre-programmed value. The TCON 340 clocks the gate drivers 310 to enable the transmissive gates of the next line and signals the multi-mode source drivers 320 to drive the transmissive subpixels to regular pixel data values, and the process repeats for each row in the pixel array 305.

To operate the panel in a transflective mode, the reflective subpixel of each pair receives the same value as the transmissive subpixel. In this mode, the multi-mode capability of the source drivers 320 is not used. The gate drivers 310 can utilize a double width pulse to enable both the transmissive gates and reflective gates at the same time. The technique of using a double width pulse through the gate driver shift register may be applicable to other schemes and modes described herein where the same source voltage value is driven to both the transmissive and reflective subpixels. The double width pulse, however, is not required to be used in this configuration.

To operate the panel in a reflective mode, the voltages on the transmissive subpixels do not matter, as the backlight is off. The display can be operated as a 3X by Y reflective device. The display can be driven the same as in the transflective mode.

Repeated Scan for Shared Source Line Circuits

Figure 4:
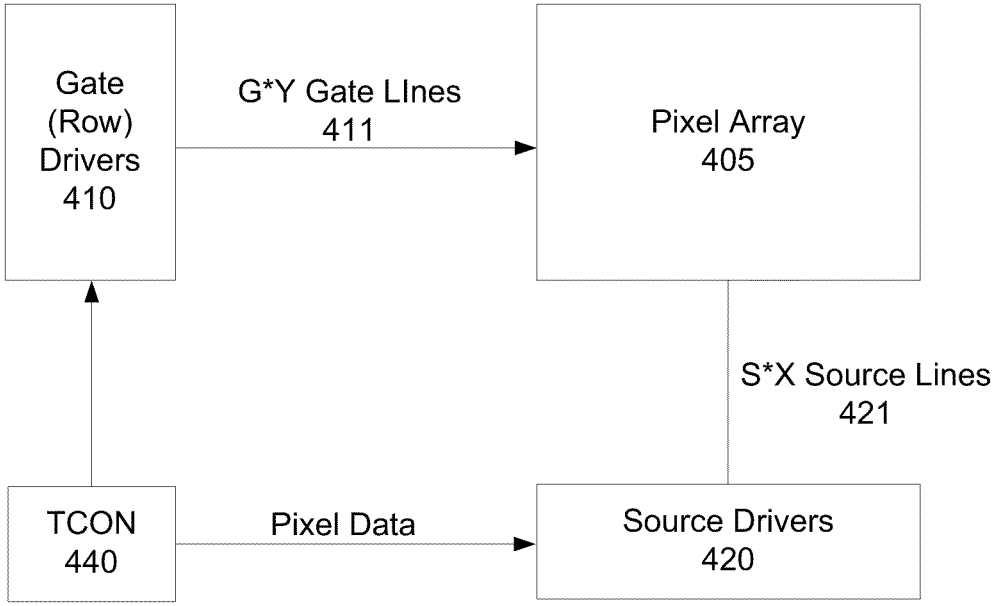
FIG. 4 shows a circuit or system for driving pixel data to the pixels of an LCD panel.

FIG. 4 shows a block diagram of a circuit or system for driving pixel data to the pixels of an LCD panel. The system comprises a pixel array 405 coupled to gate row drivers 410 by gate lines 411, wherein the number of gate lines 411 is equal to the number of rows (Y) in the pixel array multiplied by the number of gates per pixel (G). The system further comprises source drivers 420 coupled to the pixel array 405 by source lines 421, wherein the number of source lines 421 equals the number of columns (X) in the display multiplied the number of source lines per pixel. The TCON 440 delivers pixel data to the source drivers 420, and the source drivers 420 drive a set of desired voltages onto the subpixels of the pixel array 405 based on the pixel data. Depending on the mode of operation of the panel, the TCON 440 can also provide black pixel values to the source drivers 420. The values of G and S can vary for various embodiments of the circuit shown in FIG. 4.

Figure 8:
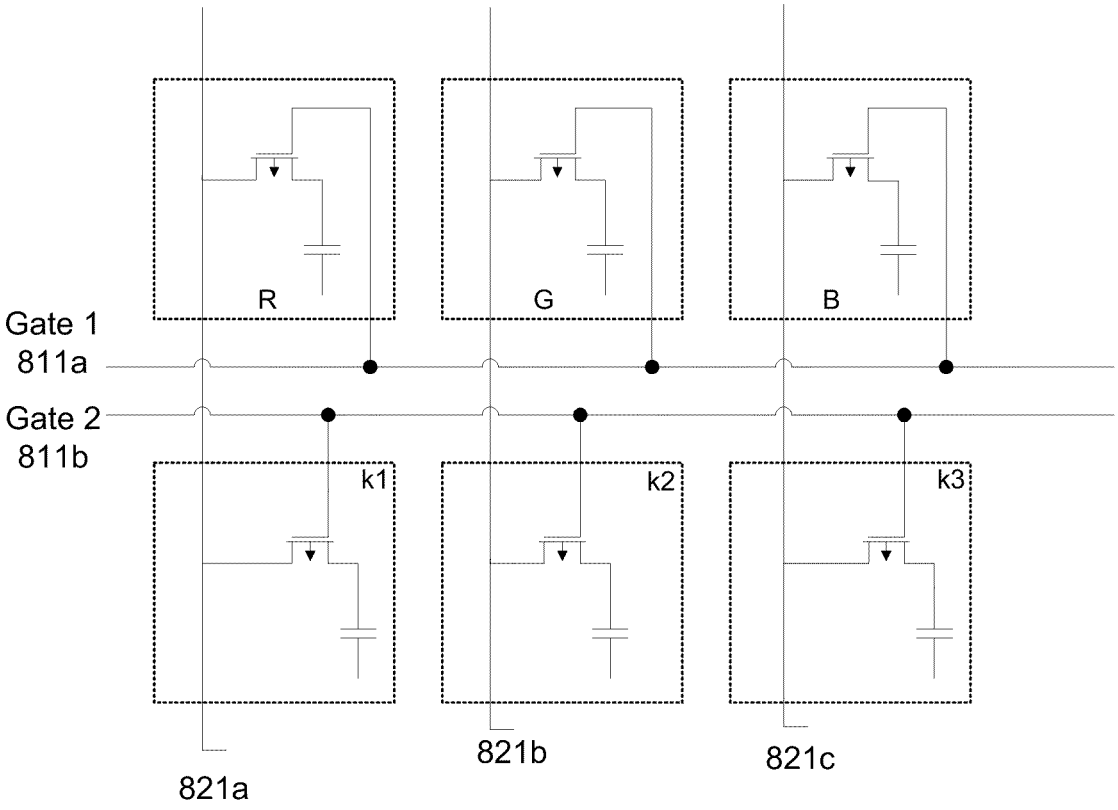
FIG. 8 shows a 3S-2G circuit where subpixel pairs can be driven to the same value by setting the source lines a single voltage and enabling both gate lines.
Figure 10A:
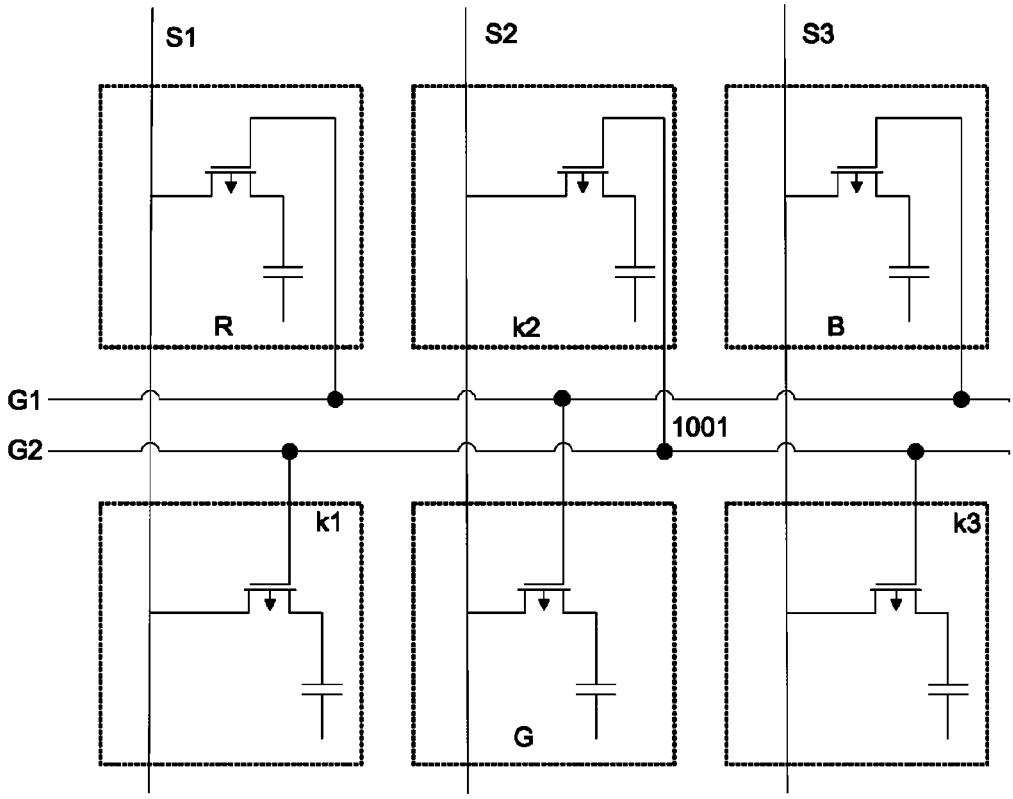
FIG. 10*a* and FIG. 10*b* show pixel circuits with typed gate lines and untyped gate lines.
Figure 10B:
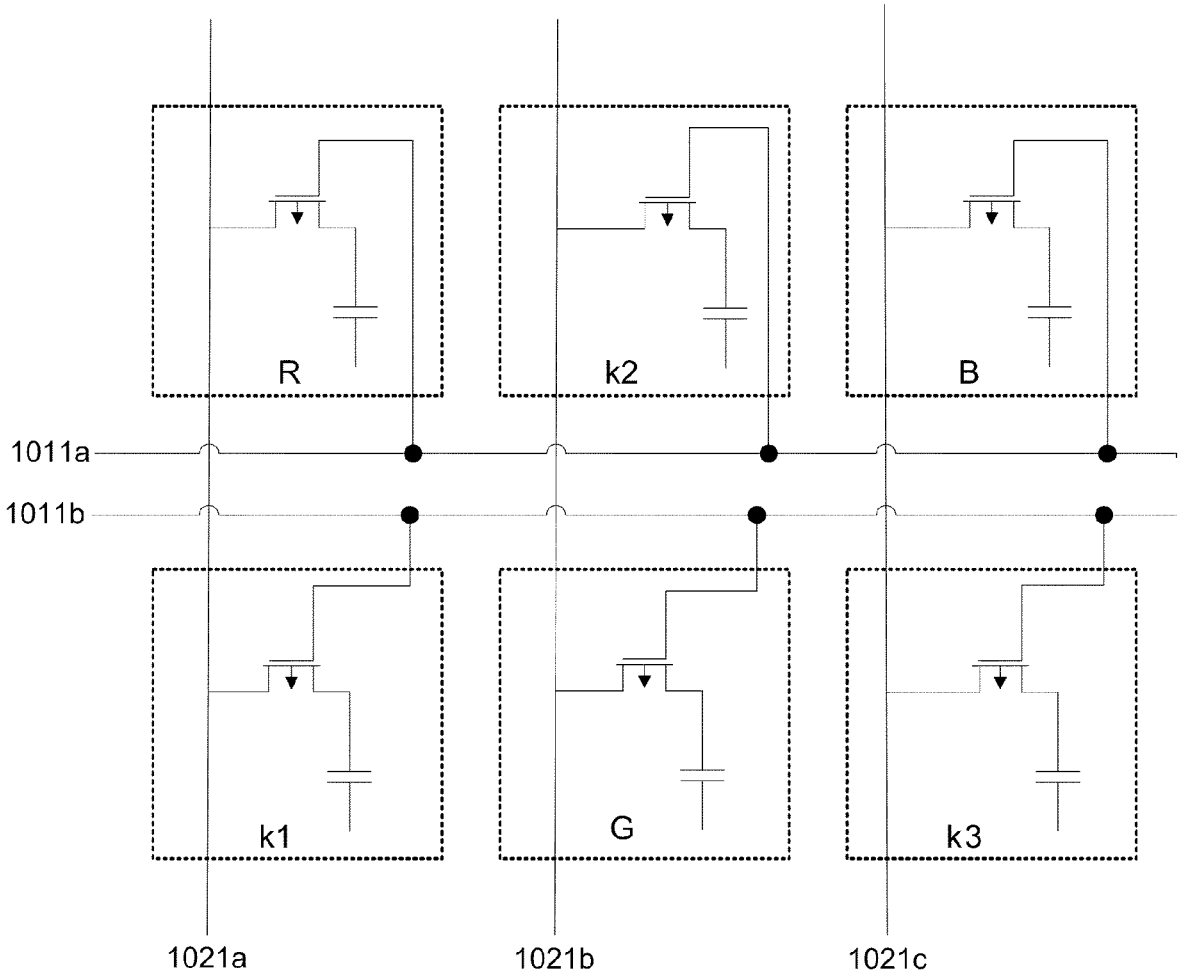

For example, in one embodiment there might be three source lines per pixel (one for each RGB/k1k2k3 subpixel pair), and two gate lines per pixel (one for the transmissive subpixels and one for the reflective subpixels). Such a circuit can be referred to as a 3S-2G circuit. Details of example 3S-2G pixel embodiments are shown in FIG. 8, FIG. 10*a*, and FIG. 10*b* and discussed below.

When operating a panel with a 3S-2G circuit in a transmissive mode, the TCON 440 causes the gate row drivers 410 to first enable the transmissive subpixels in a row so that the source drivers 420 can load image data to the transmissive subpixels. The TCON 440 then causes the gate row drivers 410 to enable the reflective subpixels in the row so that the source drivers can load a preprogrammed value, such as a black voltage value, onto the reflective subpixels. The pixel data and black voltage value are supplied to the source drivers 420 by the TCON 440. This process can repeat until every row in pixel array 405 has been addressed.

When operating a panel with a 3S-2G circuit in a transflective mode, the reflective subpixel of each pair can be loaded with the same value as the transmissive subpixel or with an independent value. The gate row drivers 410 can enable both the transmissive subpixels and reflective subpixels of a row at the same time with a double width pulse. In a transflective mode, the TCON 440 only sends pixel data, and not black pixel values, to the source drivers 420. This process can repeat until every row in the pixel array 405 has been addressed. Loading the reflective subpixel of each pair with the same value as the transmissive subpixel or with an independent value is not required in all embodiments; having separately addressable transmissive and reflective subpixels provides the ability in transflective mode to send different values. For example, in an embodiment having three transmissive subpixels and one reflective subpixel, the reflective subpixel value can be a function of the three transmissive subpixel values, or some other independent value.

When operating a panel with a 3S-2G circuit in a reflective mode, the voltages on the transmissive subpixels do not matter because the backlight is off. Otherwise, the display is driven the same as in the transflective mode.

In another embodiment of the system shown in FIG. 4, the transmissive subpixel and reflective subpixel portions of pixels in a row can have independent source lines 421 and a shared gate line 411. For example, there might be six source lines per pixel (one for each RGB reflective subpixel and one for each transmissive subpixel), and one gate line (all six subpixels share the same gate line). Such a circuit can be referred to as a 6S-1G circuit. When a panel with a 6S-1G circuit operates in a transmissive mode, the TCON 440 can deliver pixel data and black pixel values to the source drivers 420, and the source drivers 420 can load on the six subpixels both black voltage values for the reflective subpixels and pixel data for the transmissive subpixels. To operate a panel with a 6S-1G circuit in a transflective or reflective mode, only the values being loaded on the various subpixels needs to change.

In alternative embodiments, configurations such as a 6S-2G circuit or 1S-6G circuit can be implemented. For example, a 6S-2G circuit can have the structure and operational characteristics of the 6S-1G circuit described above, but with independent control of the reflective subpixels. As another example, a display operating in a transmissive mode and using pixels with a 1S-6G configuration, all red pixel values in a row can be loaded, then green pixel values, then blue pixel values, and then black voltage values for the reflective subpixels in the row.

Variants

Figure 5:
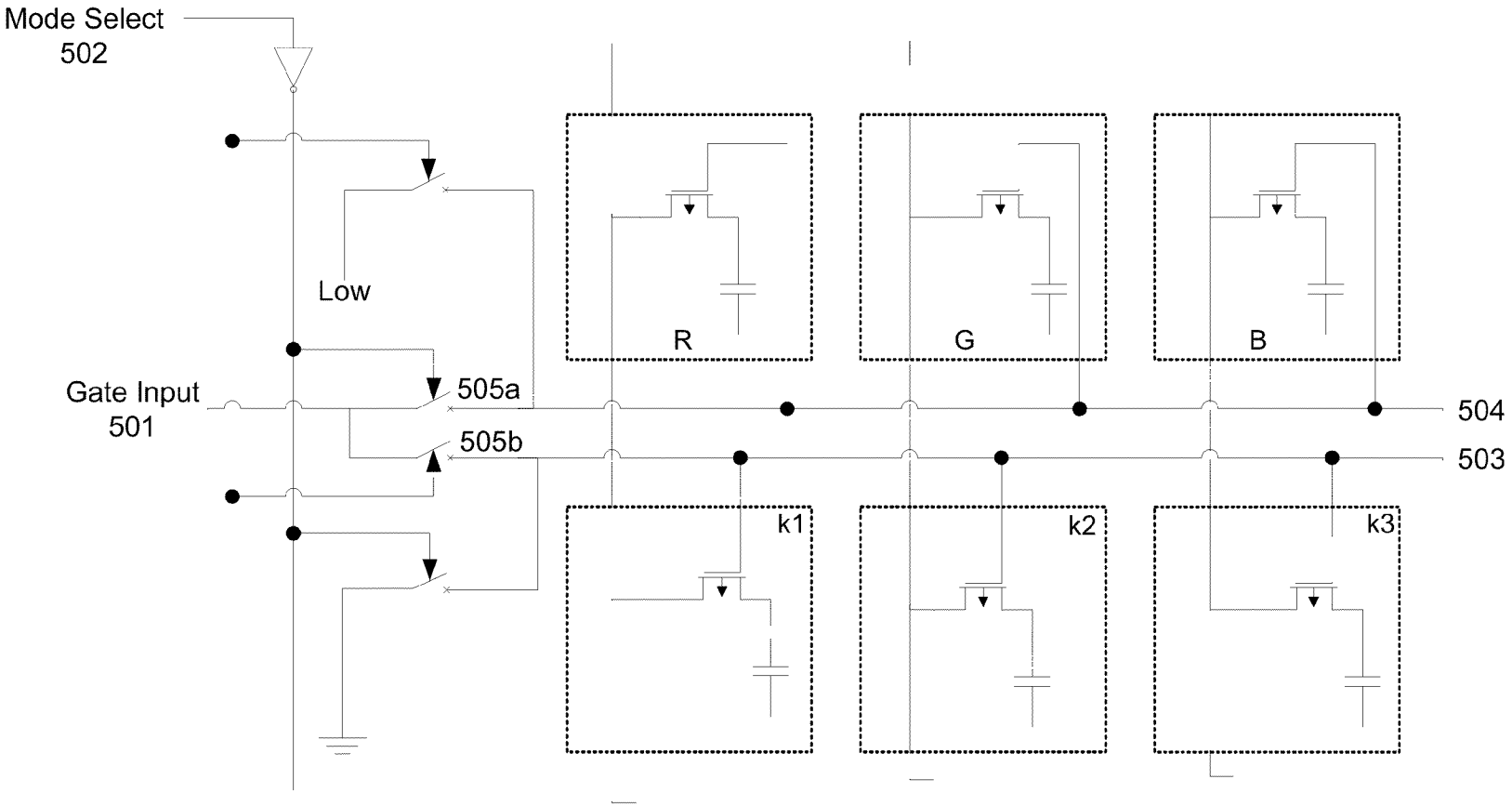
FIG. 5 shows a pixel comprising subpixels with transmissive portions and reflective portions.

Several variants of the circuits discussed thus far can be implemented. For example, FIG. 5 shows a schematic of a pixel comprising subpixels with transmissive subpixel portions (R, G, B) and reflective subpixel portions (k1, k2, k3). The embodiment of FIG. 5 reduces the number of gate row drivers by half by having either the reflective gate lines 503 or transmissive gate lines 504 controlled by an external global gate input 501. In some embodiments, control is achieved by placing large driving transistors on the display glass. In this circuit, when the reflective subpixels (k1, k2, k3) of an active line are to be addressed, instead of clocking the shift register, a mode select signal 502 is toggled, connecting the reflective row gate line 503 to the gate input 501 and connecting the transmissive gate line 504 to a low voltage. This approach reduces the number of gate row drivers by a factor of two while adding the global mode select signal 502. Assertion and timing of the mode select signal 502 may be done either by an external timing logic controller or internally in a TCON.

Depending on the desired mode of operation, closing a first switch 505*a* and opening a second switch 505*b* can enable just the transmissive subpixel portions (R, G, B). Opening a first switch 505*a* and closing a second switch 505*b* can enable just the reflective subpixel portions (k1, k2, k3). Closing both a first switch 505*a* and second switch 505*b* can enable simultaneously both the reflective subpixel portions (k1, k2, k3) and the transmissive subpixel portions (R, G, B).

Internally Multiplexed Source Configuration

Figure 6:
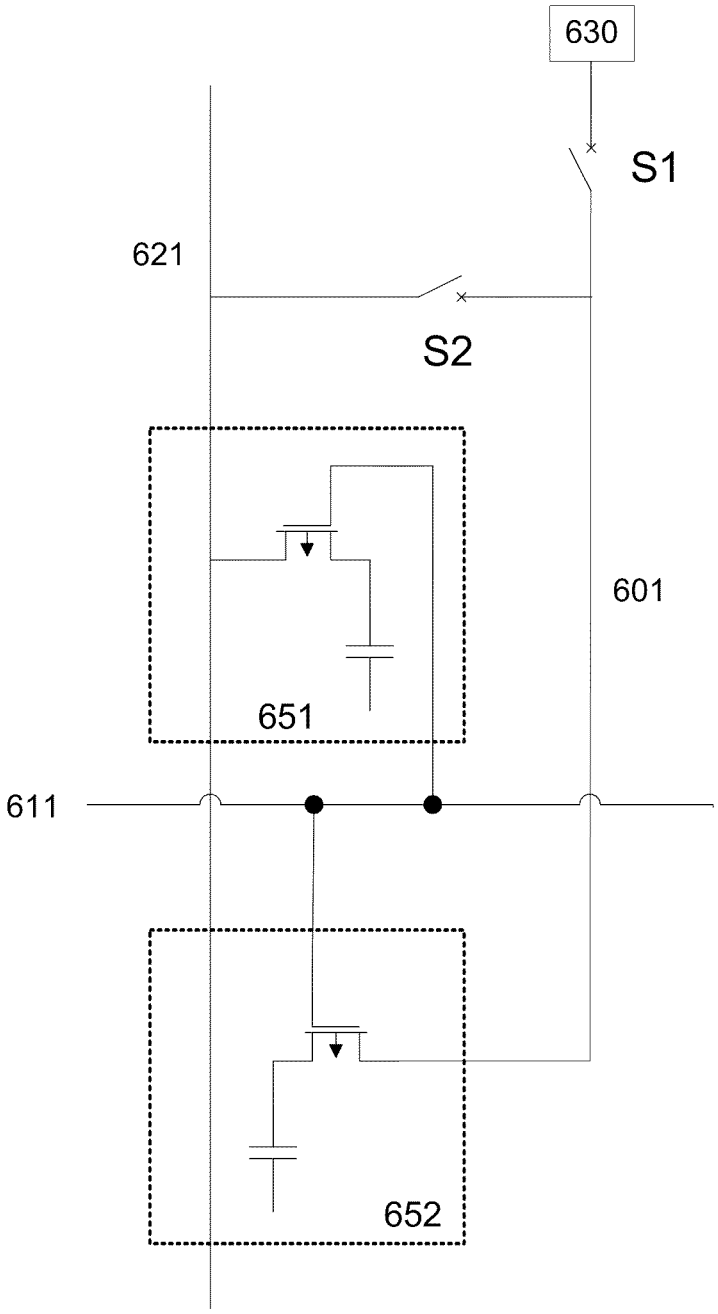
FIG. 6 shows an internally multiplexed subpixel pair with a transmissive subpixel and a reflective subpixel.

FIG. 6 shows a diagram of an internally multiplexed subpixel pair with a transmissive subpixel 651 and a reflective subpixel 652. The reflective source line 601 is connected to one of two input sources with internal transistors to enable transflective behavior. The reflective source line 601 is connected either to an external black voltage generator 630 or to the corresponding transmissive subpixel's 651 source line 621. When switch S1 is open and switch S2 is closed, the reflective subpixel 652 gets the same voltage as the transmissive subpixel 651, which can be used in transflective and reflective modes. When S1 is closed and S2 is open, the reflective subpixel 652 gets the voltage provided by the black voltage generator 630.

Example Circuit Topologies for Pixels

FIG. 8 shows an example of a 3S-2G circuit. By setting source lines 821*a-c* to a set of particular voltages and enabling both gate lines 811*a-b*, subpixel pairs R & k1 can be driven to the same value, G & k2 to the same value, and B & k3 to the same value. The gate lines 811*a-b* can be enabled either simultaneously to drive both subrows at the same time for maximum speed or sequentially to simplify external circuitry.

Subpixel pairs can also be driven independently, by first enabling a first gate line 811*a* and driving a particular set of voltages on the source lines 821*a-c*, and then by enabling the second gate line 811*b* and driving a second particular set of voltage on the source lines 821*a-c*.

All the subpixels of one type in the entire array may be updated before updating any of the subpixels of the other type. For example, it may be desirable to load all the transmissive values in one pass through the display, and then drive all reflective pixels at the same time with the same voltage. For example, in a purely transmissive mode, the reflective pixels can all be driven to black. A power or speed optimization may be possible using this update technique.

In an alternative embodiment, all reflective gate lines, such as gate line 811*b*, can be coupled or shorted together through transistors on the panel to present only one global gate line, allowing for a rapid update of all the reflective subpixels to a single value. Shorting alternate gate lines can support a line inversion mode, allowing for a rapid update of alternating reflective subpixels to two voltages.

Figure 9:
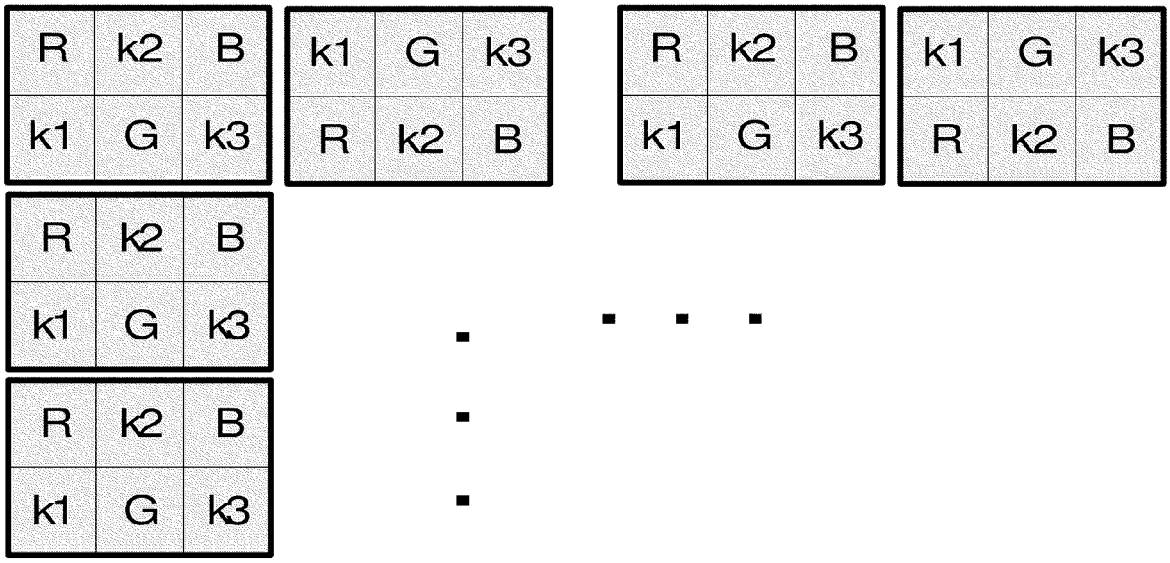
FIG. 9 shows an "interleaved subpixel" design.

FIG. 9 shows an embodiment of an "interleaved subpixel" structure or circuit. In such a design, the reflective and transmissive subpixels are alternated on the same rows as shown in FIG. 9. In FIG. 9, R, G, and B refer to transmissive subpixels and k1, k2, and k3 refer to reflective subpixels. If the gate wires are "typed" to only connect to the same type of subpixel (either transmissive or reflective, but not both), then the two gate wires may cross over each other to reach the correct type of subpixel. FIG. 10*a* is an example such a configuration with a crossover 1001.

Alternatively, as shown in FIG. 10*b*, the gate lines can be "untyped" so that the same gate line, for example gate lines 1011*a-b*, addresses both reflective and transmissive subpixels that are in the same subrow. For example, in FIG. 10*b*, gate line 1011*a* is coupled to transmissive subpixels R and B and reflective subpixel k2. Gate line 1011*b* is coupled to reflective subpixels k1 and k3 and transmissive subpixel G. As a result, no crossovers are required.

However, because reflective and transmissive subpixels are addressed at the same time, the technique of time-multiplexing the source lines 1021*a-c* between black voltages and color voltages is not used. Instead, the TCON may deliver appropriate pixel values to the transmissive as well as the reflective subpixels.

Figure 11:
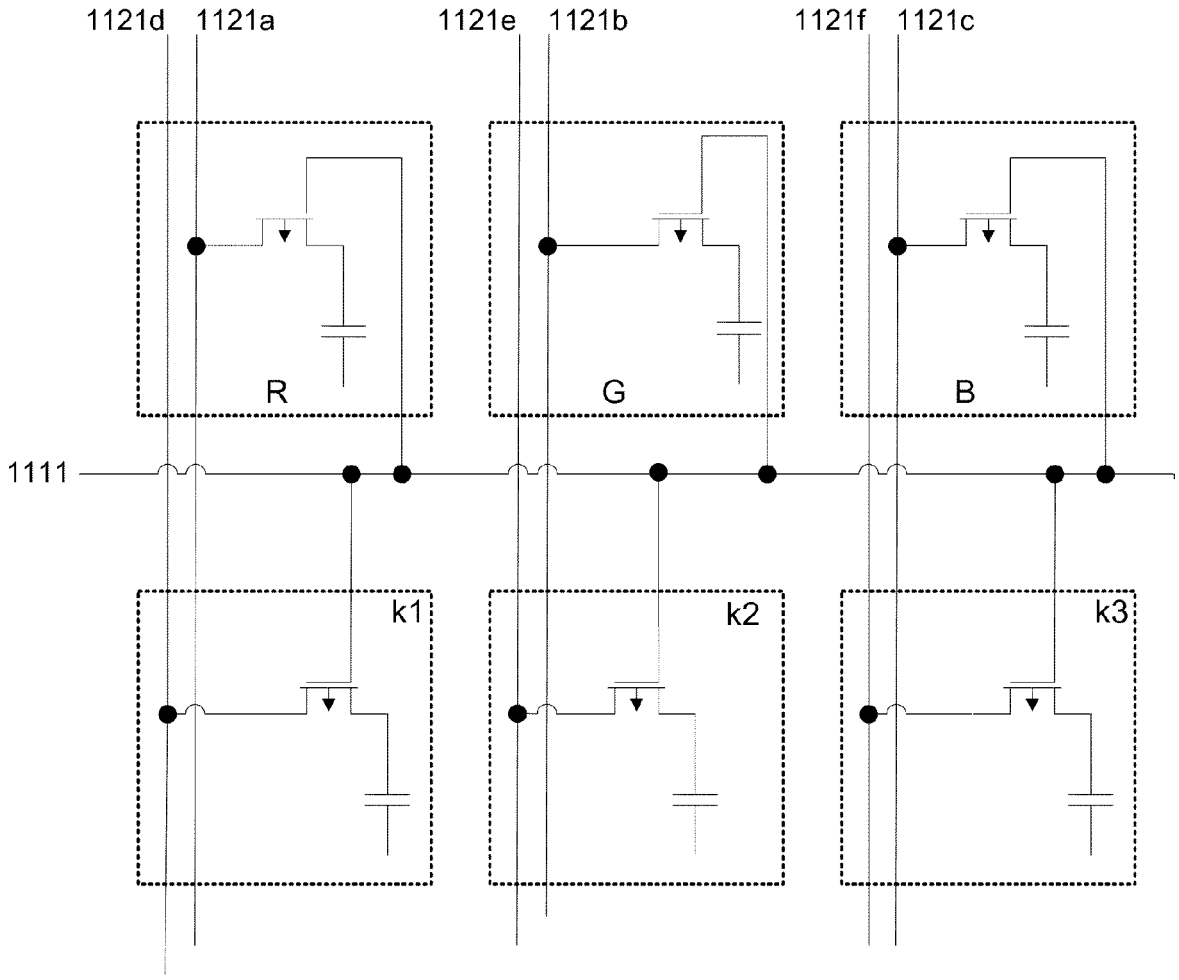
FIG. 11 shows an example of a 6S-1G circuit.

In alternative embodiments, separate source lines are provided for both transmissive and reflective pixels. FIG. 11 shows an example of a 6S-1G circuit. The circuit of FIG. 11 comprises one gate line and six source lines 1121*a-f*. Source lines 1121*a-c* address the transmissive subpixels, and source lines 1121*d-f* address the reflective subpixels.

Figure 12:
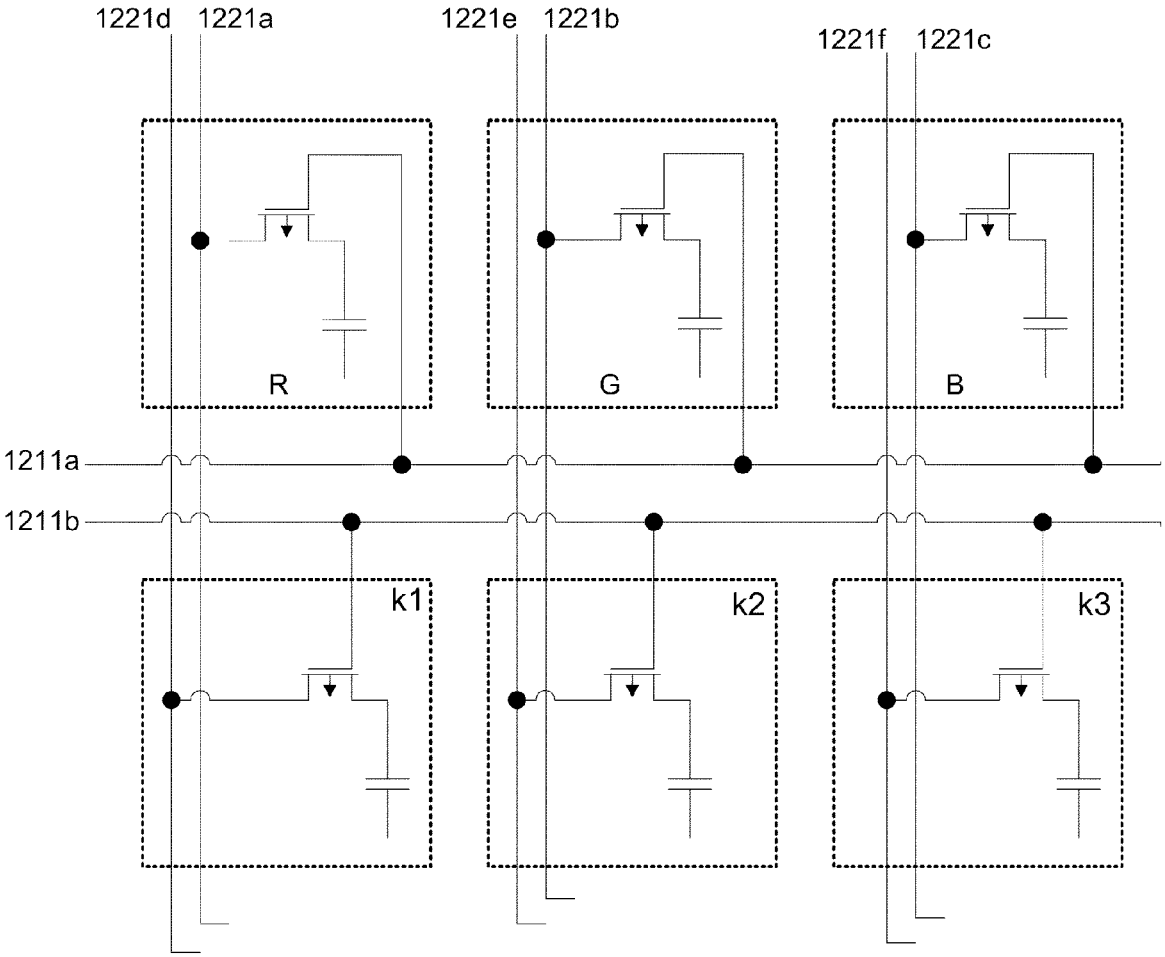
FIG. 12 shows a 6S-2G circuit with separate gate lines for the reflective and transmissive subpixels.

FIG. 12 shows an example of a 6S-2G circuit with separate gate lines 1211*a-b* for the reflective (k1, k2, k3) and transmissive (R, G, B) subpixels. The circuit of FIG. 12 further comprises six source lines 1221*a-f*. With the circuit shown in FIG. 12, the display behaves as if it consists of two overlaid displays: one transmissive and one reflective. Thus, the transmissive subpixels can be addressed by conventional circuitry, while the reflective subpixels can have their own separate drivers operating at their own clock rate. FIG. 12 shows an example of a typed 6S-2G circuit, but untyped embodiments can be implemented as well.

Figure 13:
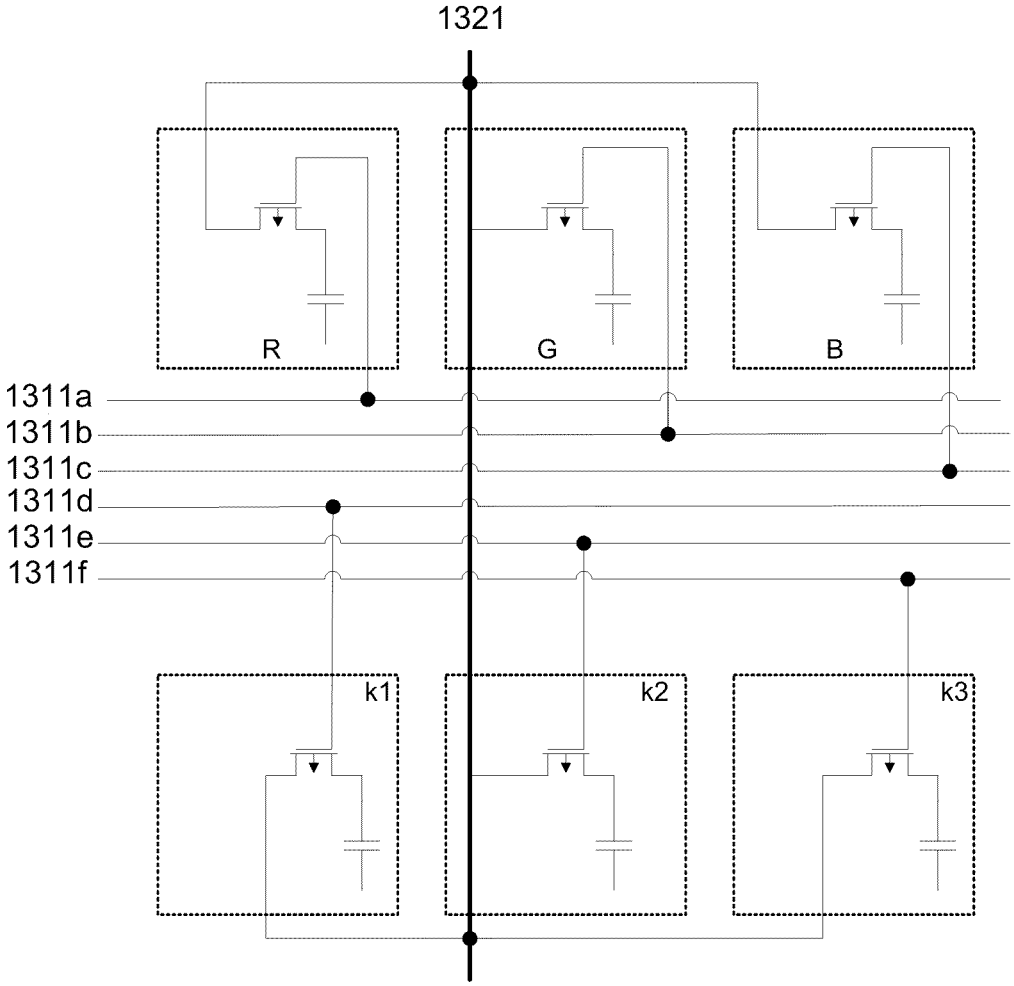
FIG. 13 shows a 1S-6G circuit that can be implemented in some configurations.

FIG. 13 shows circuitry for a 1S-6G circuit that can be implemented in some configurations. The circuit of FIG. 13 comprises six gate lines 1311*a-f* and one source line 1321. Such a design may be useful when source drivers are expensive or it is otherwise desirable to reduce the number of source drivers.

Figure 14:
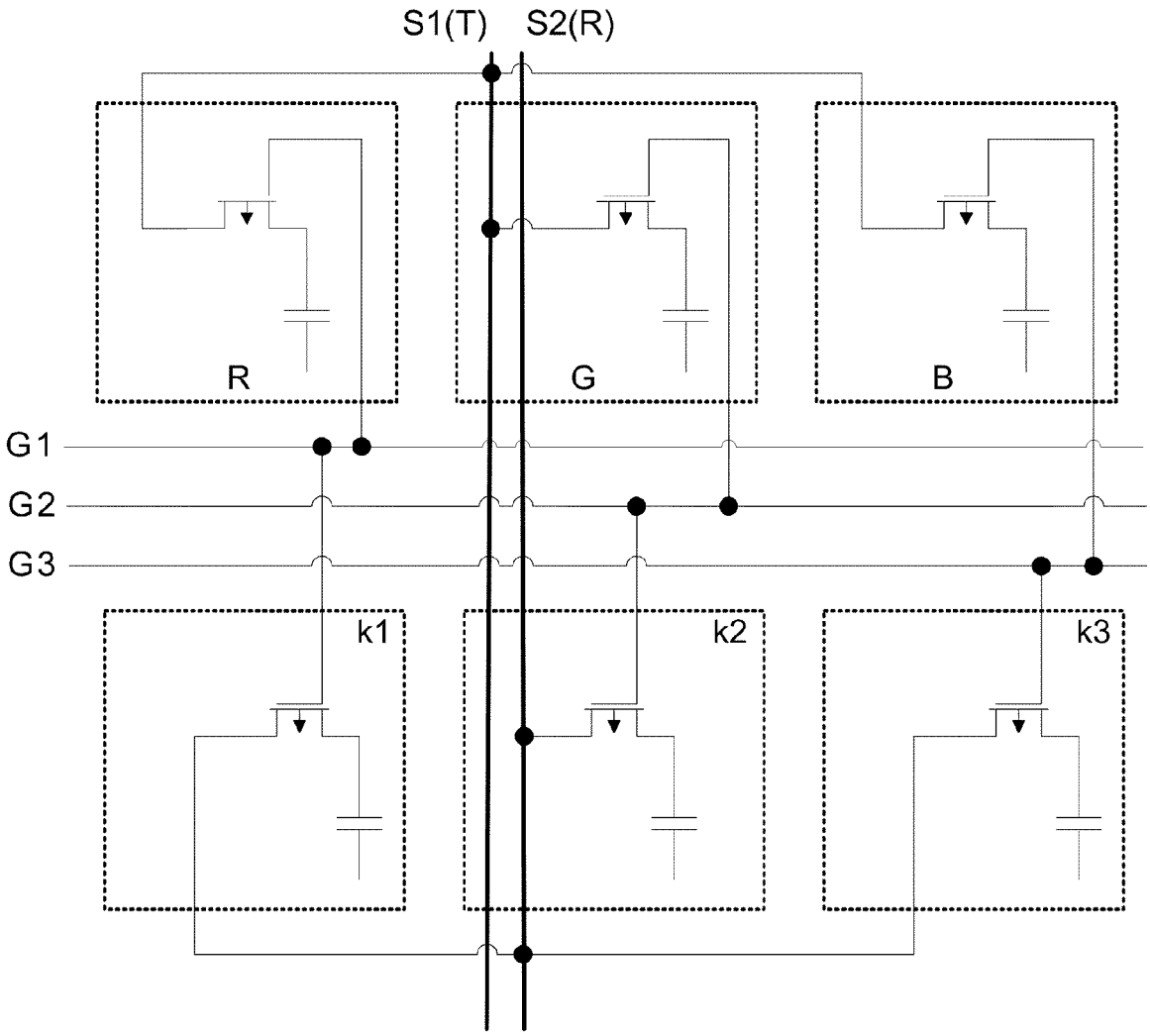
FIG. 14 shows a 2S-3G circuit that drives the reflective and transmissive elements simultaneously.

FIG. 14 shows an example of a 2S-3G circuit that drives the transmissive (R, G, B) and reflective (k1, k2, k3) elements simultaneously, but is sequenced for each color. A first source driver S1(T) drives the transmissive (R, G, B) elements, and a second source driver S2(R) drives the reflective (k1, k2, k3) elements. The driving scheme presents a single color to the display at a time. The circuit uses fewer source drivers than a conventional LCD. The circuit also enables a high-speed low-resolution grayscale mode. If all gate lines are addressed simultaneously, then every subpixel of the same type will store the same source line voltage.

The embodiments described all incorporate a "hexad" structure of six subpixels: 3 transmissive subpixels and 3 reflective subpixels. However, in alternative embodiments, the circuits herein may be used with structures having multispectral configurations (RGBY, for example), or having multiple subpixels of the same color.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A pixel driving circuit comprising:

wherein the pixel driving circuit is a part of a display that comprises one or more subpixel pairs including a subpixel pair and that is capable of operating in a transmissive mode, a reflective mode, and a transflective mode;

a gate row driver for enabling one or more subpixels of the one or more subpixel pairs to receive data;

a source driver for driving the data to the one or more subpixels;

switching logic configured to cause the pixel driving circuit to operate in a plurality of configurations comprising:

a first configuration wherein the gate row driver enables a first subpixel of the subpixel pair to receive first data from the source driver, wherein the first data comprises a first value, wherein the first value is to cause the first subpixel to display a first luminance, a second configuration wherein the gate row driver enables a second subpixel of the subpixel pair to receive second data from the source driver, the second data being different than the first data, wherein the second data comprises a second value, wherein the second value is to cause the second subpixel to display with a second luminance different from the first luminance;

wherein the switching logic is further configured to cause the pixel driving circuit to operate in a third configuration wherein the gate row driver enables the first subpixel to receive third data from the source driver and the second subpixel to receive the third data from the source driver.

2. A pixel driving circuit comprising:

wherein the pixel driving circuit is a part of a display that comprises a subpixel pair and that is capable of operating in a transmissive mode, a reflective mode, and a transflective mode;

a gate row driver configured to enable a first subpixel of the subpixel pair to receive first data and to enable a second subpixel of the subpixel pair to receive second data;

wherein the first data comprises a first value, wherein the first value is to cause the first subpixel to display a first luminance, wherein the second data comprises a second value, wherein the second value is to cause the second subpixel to display with a second luminance different from the first luminance;

a first source driver configured to drive the first data to the first subpixel;

a second source driver configured to drive the second data to the second subpixel, wherein the second data is different than the first data;

wherein the gate row driver is further configured to enable a third subpixel of a second subpixel pair to receive third data;

a third source driver configured to drive the third data to the third subpixel.

3. The pixel driving circuit of claim 1, wherein the first subpixel of the subpixel pair is a transmissive subpixel and the second subpixel of the subpixel pair is a reflective subpixel.

4. The pixel driving circuit of claim 1, wherein the second data is a black voltage value.

5. The pixel driving circuit of claim 1, wherein the subpixel pair represents a pixel in a plurality of pixels arranged in rows and columns.

6. The pixel driving circuit of claim 1, further comprising:

mode selection logic configured to cause the display to operate in a plurality of modes comprising the transmissive mode, the reflective mode, and the transflective mode.

7. The pixel driving circuit of claim 2, wherein the first subpixel of the subpixel pair is a transmissive subpixel and the second subpixel of the subpixel pair is a reflective subpixel.

8. The pixel driving circuit of claim 2, wherein the second data is a black voltage value.

9. The pixel driving circuit of claim 2, wherein the subpixel pair represents a pixel in a plurality of pixels arranged in rows and columns.

10. The pixel driving circuit of claim 2, further comprising:

mode selection logic configured to cause the display to operate in a plurality of modes comprising the transmissive mode, the reflective mode, and the transflective mode.

11. A display panel comprising:

a plurality of subpixel pairs representing pixels in the display panel; and a pixel driving circuit comprising:

wherein the pixel driving circuit is a part of a display that comprises one or more subpixel pairs including a subpixel pair and that is capable of operating in a transmissive mode, a reflective mode, and a transflective mode;

a gate row driver for enabling one or more subpixels of the one or more subpixel pairs to receive data;

a source driver for driving the data to the one or more subpixels;

switching logic configured to cause the pixel driving circuit to operate in a plurality of configurations comprising:

a first configuration wherein the gate row driver enables a first subpixel of the subpixel pair to receive first data from the source driver, wherein the first data comprises a first value, wherein the first value is to cause the first subpixel to display a first luminance, a second configuration wherein the gate row driver enables a second subpixel of the subpixel pair to receive second data from the source driver, the second data being different than the first data, wherein the second data comprises a second value, wherein the second value is to cause the second subpixel to display with a second luminance different from the first luminance;

wherein the switching logic is further configured to cause the pixel driving circuit to operate in a third configuration wherein the gate row driver enables the first subpixel to receive third data from the source driver and the second subpixel to receive the third data from the source driver.

12. The display panel of claim 11, wherein the first subpixel of the subpixel pair is a transmissive subpixel and the second subpixel of the subpixel pair is a reflective subpixel.

13. The display panel of claim 11, wherein the second data is a black voltage value.

14. The display panel of claim 11, wherein the subpixel pair represents a pixel in a plurality of pixels arranged in rows and columns.

15. The display panel of claim 11, wherein the pixel driving circuit further comprises:

mode selection logic configured to cause the display to operate in a plurality of modes comprising the transmissive mode, the reflective mode, and the transflective mode.

16. A display panel comprising:

a plurality of subpixel pairs representing pixels in the display panel; and a pixel driving circuit comprising:

wherein the pixel driving circuit is a part of a display that comprises a subpixel pair and that is capable of operating in a transmissive mode, a reflective mode, and a transflective mode;

a gate row driver configured to enable a first subpixel of the subpixel pair to receive first data and to enable a second subpixel of the subpixel pair to receive second data;

wherein the first data comprises a first value, wherein the first value is to cause the first subpixel to display a first luminance, wherein the second data comprises a second value, wherein the second value is to cause the second subpixel to display with a second luminance different from the first luminance;

a first source driver configured to drive the first data to the first subpixel;

a second source driver configured to drive the second data to the second subpixel, wherein the second data is different than the first data;

wherein the gate row driver is further configured to enable a third subpixel of a second subpixel pair to receive third data;

a third source driver configured to drive the third data to the third subpixel.

17. The display panel of claim 16, wherein the first subpixel of the subpixel pair is a transmissive subpixel and the second subpixel of the subpixel pair is a reflective subpixel.

18. The display panel of claim 16, wherein the second data is a black voltage value.

19. The display panel of claim 16, wherein the subpixel pair represents a pixel in a plurality of pixels arranged in rows and columns.

20. The display panel of claim 16, wherein the pixel driving circuit further comprises:

mode selection logic configured to cause the display to operate in a plurality of modes comprising the transmissive mode, the reflective mode, and the transflective mode.

21. An apparatus comprising:

a plurality of subpixel pairs representing pixels; and a pixel driving circuit comprising:

wherein the pixel driving circuit is a part of a display that comprises one or more subpixel pairs including a subpixel pair and that is capable of operating in a transmissive mode, a reflective mode, and a transflective mode;

a gate row driver for enabling one or more subpixels of the one or more subpixel pairs to receive data;

a source driver for driving the data to the one or more subpixels;

switching logic configured to cause the pixel driving circuit to operate in a plurality of configurations comprising:

a first configuration wherein the gate row driver enables a first subpixel of the subpixel pair to receive first data from the source driver, wherein the first data comprises a first value, wherein the first value is to cause the first subpixel to display a first luminance, a second configuration wherein the gate row driver enables a second subpixel of the subpixel pair to receive second data from the source driver, the second data being different than the first data, wherein the second data comprises a second value, wherein the second value is to cause the second subpixel to display with a second luminance different from the first luminance;

wherein the switching logic is further configured to cause the pixel driving circuit to operate in a third configuration wherein the gate row driver enables the first subpixel to receive third data from the source driver and the second subpixel to receive the third data from the source driver.

22. The apparatus of claim 21, wherein the first subpixel of the subpixel pair is a transmissive subpixel and the second subpixel of the subpixel pair is a reflective subpixel.

23. The apparatus of claim 21, wherein the second data is a black voltage value.

24. The apparatus of claim 21, wherein the subpixel pair represents a pixel in a plurality of pixels arranged in rows and columns.

25. The apparatus of claim 21, wherein the pixel driving circuit further comprises:

mode selection logic configured to cause the display to operate in a plurality of modes comprising the transmissive mode, the reflective mode, and the transflective mode.

26. An apparatus comprising:

a plurality of subpixel pairs representing pixels; and a pixel driving circuit comprising:

wherein the pixel driving circuit is a part of a display that comprises a subpixel pair and that is capable of operating in a transmissive mode, a reflective mode, and a transflective mode;

a gate row driver configured to enable a first subpixel of the subpixel pair to receive first data and to enable a second subpixel of the subpixel pair to receive second data;

wherein the first data comprises a first value, wherein the first value is to cause the first subpixel to display a first luminance, wherein the second data comprises a second value, wherein the second value is to cause the second subpixel to display with a second luminance different from the first luminance;

a first source driver configured to drive the first data to the first subpixel;

a second source driver configured to drive the second data to the second subpixel, wherein the second data is different than the first data;

wherein the gate row driver is further configured to enable a third subpixel of a second subpixel pair to receive third data;

a third source driver configured to drive the third data to the third subpixel.

27. The apparatus of claim 26, wherein the first subpixel of the subpixel pair is a transmissive subpixel and the second subpixel of the subpixel pair is a reflective subpixel.

28. The apparatus of claim 26, wherein the second data is a black voltage value.

29. The apparatus of claim 26, wherein the subpixel pair represents a pixel in a plurality of pixels arranged in rows and columns.

30. The apparatus of claim 26, wherein the pixel driving circuit further comprises:

mode selection logic configured to cause the display to operate in a plurality of modes comprising the transmissive mode, the reflective mode, and the transflective mode.

* * * * *